US011485146B2

(12) United States Patent
Bhaskaran et al.

(10) Patent No.: US 11,485,146 B2
(45) Date of Patent: Nov. 1, 2022

(54) INK CARTRIDGE ACTIVATION

(71) Applicant: Hewlett-Packard Development Company, L.P., Spring, TX (US)

(72) Inventors: Shinoj Bhaskaran, Bangalore (IN); Subhash Pulikkara Veedu, Bangalore (IN)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/278,417

(22) PCT Filed: Nov. 6, 2019

(86) PCT No.: PCT/US2019/060019

§ 371 (c)(1),
(2) Date: Mar. 22, 2021

(87) PCT Pub. No.: WO2020/117417

PCT Pub. Date: Jun. 11, 2020

(65) Prior Publication Data

US 2021/0387458 A1 Dec. 16, 2021

(30) Foreign Application Priority Data

Dec. 4, 2018 (IN) ..... 201841045876

(51) Int. Cl.
*B41J 2/175* (2006.01)

(52) U.S. Cl.
CPC ..... *B41J 2/17566* (2013.01); *B41J 2/17546* (2013.01); *B41J 2002/17569* (2013.01); *B41J 2002/17589* (2013.01)

(58) Field of Classification Search
CPC ..... B41J 2/17566; B41J 2/17546; B41J 2002/17569; B41J 2002/17589
See application file for complete search history.

(56) References Cited

U.S. PATENT DOCUMENTS 6,145,947 A 11/2000 Inora et al.
6,158,837 A 12/2000 Hilton et al.
(Continued)

FOREIGN PATENT DOCUMENTS

CN 101066642 A 11/2007
CN 103098069 A 5/2013
(Continued)

OTHER PUBLICATIONS

Ruijuan, S., et al., "Study on Development of UV Digital Ink-jet Printer and Its Application in Production of Lacquer Painting," Furniture, vol. 37, No. 1, 2016, pp. 28-33, p. 48,(English Abstract only).

*Primary Examiner* — Sharon Polk
(74) *Attorney, Agent, or Firm* — HP Inc. Patent Department

(57) ABSTRACT

An Imaging device includes a print monitoring engine to monitor an ink level of an ink cartridge installed in the imaging device and track a print count for each ink level. The print count for each ink level indicates a number of prints printed during a one percent drop in the ink level. Further, a print capacity estimation engine is to determine an average print rate for the ink cartridge based on the print count for each one percent drop in ink level and determine a print capacity estimate of the ink cartridge based at least on the average print rate and the current ink level. Further, an Ink cartridge controlling engine is to deactivate the ink cartridge upon occurrence of a predetermined event and activate the deactivated ink cartridge in response to an activation input from a user, wherein the activation input is based on the print capacity estimate.

15 Claims, 5 Drawing Sheets

(56) References Cited

U.S. PATENT DOCUMENTS

| | | | | |
|---|---|---|---|---|
| 6,454,381 | B1 | 9/2002 | Olsen et al. | |
| 7,747,180 | B2 | 6/2010 | Wittenauer et al. | |
| 8,164,780 | B2 | 4/2012 | Katoh et al. | |
| 9,168,737 | B1 | 10/2015 | Oi | |
| 2002/0191039 | A1 | 12/2002 | Minowa et al. | |
| 2008/0111842 | A1* | 5/2008 | Hall | B41J 2/17566 347/7 |

FOREIGN PATENT DOCUMENTS

| | | | | |
|---|---|---|---|---|
| CN | 105058987 | A | 11/2015 | |
| CN | 106104461 | A | 11/2016 | |
| CN | 106427218 | A | 2/2017 | |
| CN | 207630763 | U | 7/2018 | |
| CN | 108621612 | A | 10/2018 | |
| EP | 0841173 | A2 | 5/1998 | |
| EP | 0903237 | A2 | 3/1999 | |
| EP | 945781 | B1 * | 8/2004 | G06F 3/121 |
| JP | 2004291644 | | 10/2004 | |
| JP | 2005022146 | | 1/2005 | |
| JP | 2014-231178 | A | 12/2014 | |
| JP | 6089971 | B2 | 3/2017 | |

* cited by examiner

INK CARTRIDGE ACTIVATION

BACKGROUND

Imaging devices are peripherals commonly used in home and office environments for obtaining printed copies of digital documents having print data, such as text or image. The imaging devices include an ink cartridge as a source of ink for printing the printed copies. Once the ink in the ink cartridge is entirely consumed, i.e., a volume of the ink has depleted to zero, the existing ink cartridge is replaced with a new ink cartridge.

BRIEF DESCRIPTION OF DRAWINGS

The detailed description is described with reference to the accompanying figures. It should be noted that the description and figures are merely examples of the present subject matter and are not meant to represent the subject matter itself.

Figure 1:
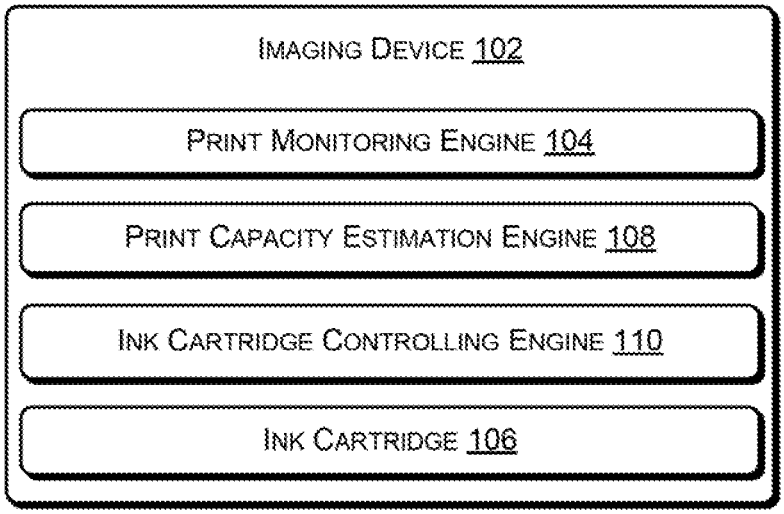
FIG. 1 illustrates an imaging device, according to an example implementation of the present subject matter.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Imaging devices are commonly used for obtaining printed copies of documents. Examples of the imaging devices include, but are not limited to, printing device, scanning devices, 3D printers, photocopy machines, and fax machines. The imaging devices may be used for performing one or more functions, such as printing, scanning of a document, photocopying of a document, and fax or email of a scanned document. The imaging devices include an ink cartridge as a source of ink for printing the printed copies. Once the ink in the ink cartridge is entirely consumed, i.e., a volume of the ink has depleted to zero, the existing ink cartridge is replaced with a new ink cartridge. Regular replacement of the ink cartridges may increase a running cost of the imaging device.

Further, if a user has a high usage of ink, the user may have to replace the ink cartridges quite frequently. For instance, if a user prints 300 pages per month and the ink cartridge has a capacity of printing around 100 prints on an average, then the user may have to replace the ink cartridges quite frequently, which may be tiresome and costly. Further, if an ink cartridge gets deactivated due to a software glitch, the user may assume the ink to have been consumed and buy a new ink cartridge even if the deactivated ink cartridge could have been activated, thus resulting in undue costs. Therefore, in order to optimize costs and reduce the efforts, the user may subscribe to ink cartridge replacement services. Such services may employ techniques that detect the current level of ink in the ink cartridge and automatically order replacement ink cartridges, whenever the ink level runs below a threshold value. For instance, the user may subscribe to a periodic print service where the user may be allowed to print a predetermined number of pages within a predetermined time period with a regular supply of ink cartridges at no extra cost during validity of the subscription. A service provider of the periodic print service may remotely track the usage of the imaging device and replace the ink cartridges whenever the ink in the ink cartridge goes below a threshold value.

Once the user unsubscribes from such services, the ink cartridge is deactivated and the user may be unable to use the ink cartridge in any imaging device to print documents, irrespective of the ink level of the ink cartridge. Thus, if a deactivated ink cartridge contains ink, the ink gets wasted, resulting in a wastage of resources. Further, the user may have to buy a new ink cartridge for regular work using the imaging device, even if the user may have to print few print documents.

The present subject matter discloses example implementations for ink cartridge activation in an imaging device. In one example implementation of the present subject matter, a deactivated ink cartridge may be activated based on a print capacity estimate of the ink cartridge, indicating the number of prints that may be obtained using remaining ink in the ink cartridge. In one example, the print capacity estimate of the ink cartridge may be determined based on an average print rate and a current ink level of the ink cartridge. The average print rate indicates an average minimum number of prints obtained using one percent volume of ink and may be determined based on print counts for each ink level beginning. Thus, once an ink cartridge gets deactivated, the ink cartridge may be activated based on the print capacity estimate of the ink cartridge, thus optimizing resource utilization and running costs.

In one example implementation of the present subject matter, once a new ink cartridge is installed in the imaging device, print monitoring engine may initiate monitoring an ink level of the ink cartridge and the print count for each one percent drop in the ink level. The ink level of the ink cartridge may indicate a percentage volume of ink in the ink cartridge. The print count for an ink level may indicate number of prints obtained during one percent drop in the ink level.

Further, upon occurrence of a predetermined event, say discontinuation of a subscription service or occurrence of a technical glitch, the imaging device may deactivate the ink cartridge. Once the ink cartridge is deactivated, the user, such as an operator of the imaging device or a service provider of the ink cartridges may obtain the print capacity estimate of the ink cartridge to determine if the ink cartridge may be activated. Initially, an average print rate for the ink cartridge may be determined based on the print count for each one percent drop in ink level beginning from the hundred percent ink level up to a current ink level of the ink cartridge.

In one example implementation, the average print rate may be determined using a concept of moving windows by creating a plurality of ink level subsets as moving windows across a plurality of ink levels. To determine the average print rate, an average print count for each ink level subset may be computed based on the print count for each ink level included in the ink level subset. In one example, the plurality of ink level subsets is created using overlapping moving windows of a predetermined width equal to a predetermined number of ink levels. The plurality of ink levels may be obtained beginning from the hundred percent ink level up to the current ink level in the numerically descending order. Further, each ink level subset may be created such that an initial ink level of the subset is determined by shifting forward the initial ink level of a preceding ink level subset by a predetermined value.

Subsequently, a lowest average print count from among average print counts obtained for the plurality of ink level subsets may be assigned as the average print rate for the ink cartridge. Further, the print capacity estimate of the ink cartridge may be determined based at least on the average print rate and the current ink level. On receiving the print capacity estimate, the user may determine whether or not to activate the ink cartridge, for example, based on the print capacity estimate and cost of re-activating the ink cartridge. The user may accordingly provide an activation input based on which the ink cartridge may be activated.

The present subject matter thus facilitates in identifying and activating ink cartridges with a desirable print capacity. Identifying the ink cartridge based on the print capacity estimate facilitates in activating selective ink cartridges that may have a substantial volume of ink that may be used by the user to optimize costs and resources. For instance, a user may choose not to activate ink cartridges having a low print capacity, say, 10 prints. However, if a user has to print 100 pages, then instead of buying a new ink cartridge, the user may decide to activate an ink cartridge that has a print capacity estimate of 200 prints and agree to pay for activating the print based on cost for 200 prints. The user may thus save on cost and efforts related to buying and installing a new ink cartridge. Further, by allowing a user to activate a deactivated ink cartridge, the present subject matter facilitates in optimizing resources by utilizing ink that may have otherwise been wasted.

Further, computing the print capacity estimate based on the lowest average print count helps in ensuring that the print capacity estimate is determined after considering adverse print conditions and high ink usage. The print capacity estimate may thus indicate a substantially accurate minimum number of prints that may be obtained using the ink cartridge.

The present subject matter is further described with reference to FIGS. 1 to 5. It should be noted that the description and figures merely illustrate principles of the present subject matter. Various arrangements may be devised that, although not explicitly described or shown herein, encompass the principles of the present subject matter. Moreover, all statements herein reciting principles, aspects, and examples of the present subject matter, as well as specific examples thereof, are intended to encompass equivalents thereof.

FIG. 1 illustrates an imaging device 102, according to an example implementation of the present subject matter. Examples of the imaging device 102 include, but are not limited to, a multifunction printer, a home printer, an office printer, a 3D printer, a scanner, and a photocopy device. In one example, the imaging device 102 may support at least printing of a document.

In one implementation, the imaging device 102 includes a print monitoring engine 104 to monitor an ink level of an ink cartridge 106 installed in the imaging device 102. The ink level indicates a percentage volume of ink in the ink cartridge 106. For example, 90% ink level may indicate that current volume of ink in the ink cartridge 106 is 90% of total ink capacity of the ink cartridge 106.

The print monitoring engine 104 further is to track a print count for each ink level. In one example, the print count for each ink level may indicate number of prints printed during one percent drop in the ink level.

The imaging device 102 further includes a print capacity estimation engine 108 to determine a print capacity estimate of the ink cartridge 106. In one example, the print capacity estimation engine 108 may determine an average print rate for the ink cartridge 106 based on the print count for each one percent drop in ink level. The average print rate indicating an average minimum number of prints obtained using one percent volume of ink. The print capacity estimation engine 108 may subsequently determine the print capacity estimate of the ink cartridge 106 based at least on the average print rate and a current ink level.

The imaging device 102 further includes an ink cartridge controlling engine 110 to activate and deactivate the ink cartridge 106. In one example, the ink cartridge controlling engine 110 may deactivate the ink cartridge 106 upon occurrence of a predetermined event, such as termination of a subscription or a technical fault in either the imaging device 102 or the ink cartridge 106. The ink cartridge controlling engine 110 may further, activate the deactivated ink cartridge 106 in response to an activation input from a user. In one example, the activation input may be based on the print capacity estimate.

Figure 2:
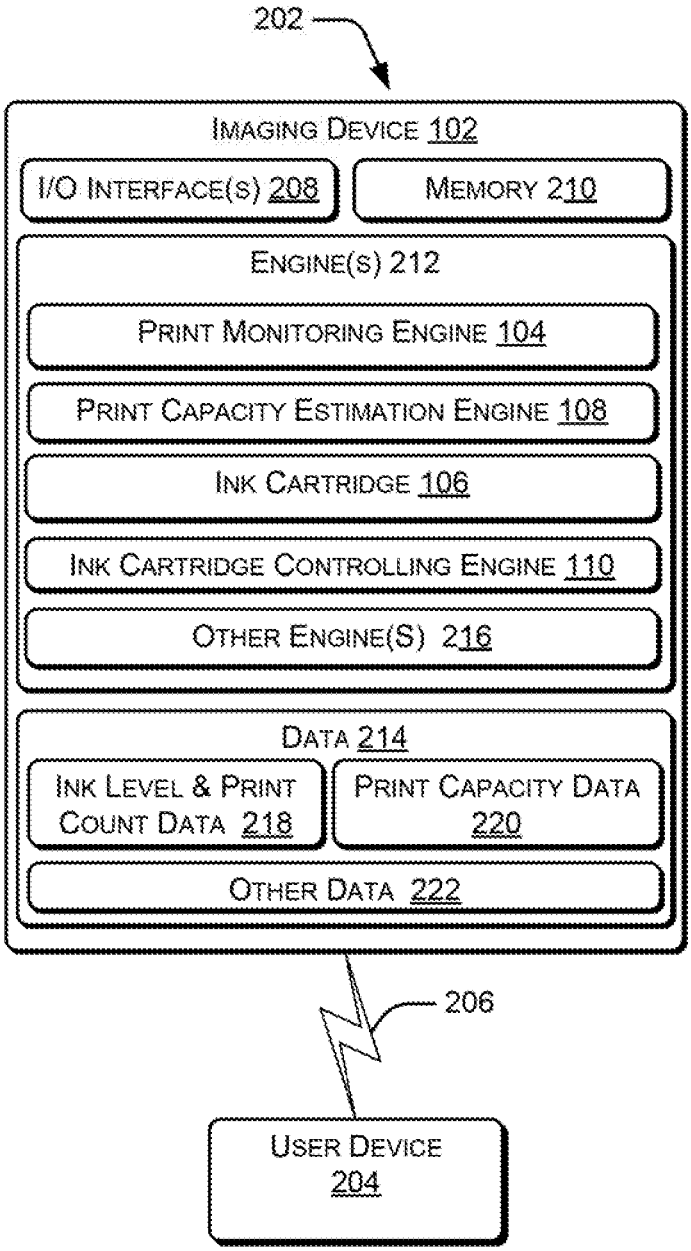
FIG. 2 illustrates an imaging system, according to an example implementation of the present subject matter.

FIG. 2 illustrates an imaging system 202, according to an example implementation of the present subject matter. The imaging system 202 includes an imaging device, such as the imaging device 102 and a user device 204 communicatively coupled to the imaging device 102. An example of the user device 204 includes, but is not limited to, desktop computers, laptops, tablets, portable computers, workstation, mainframe computer, servers, and network servers. Examples of the imaging device 102 include, but are not limited to, a multifunction printer, a home printer, an office printer, a 3D printer, a scanner, and a photocopy device. The present approaches may also be implemented in other types of user device 204 and imaging device 102 without deviating from the scope of the present subject matter. Further, the user device 204 may be used to implement various functionalities of the imaging device 102, for example, functionalities implemented by the print monitoring engine 104, the print capacity estimation engine 108, and the ink cartridge controlling engine 110.

The user device 204 and the imaging device 102 may be connected with each other over a communication network 206. The user device 204 may be used by a user, such as an operator of the imaging device 102. Further, a service provider may remotely connect to the imaging device 102 using the communication network 206. The communication network 206 may be a wireless network, a wired network, or a combination thereof. The communication network 206 can also be an individual network or a collection of many such individual networks, interconnected with each other and functioning as a single large network, e.g., the Internet or an intranet. The communication network 206 can be one of the different types of networks, such as intranet, local area network (LAN), wide area network (WAN), and the internet. In an example, the communication network 206 may include any communication network that use any of the commonly used protocols, for example, Hypertext Transfer Protocol (HTTP), and Transmission Control Protocol/Internet Protocol (TCP/IP).

The imaging device 102 includes input/output (I/O) interface(s) 208 and memory 210. The I/O interface(s) 208 may include a variety of interfaces, for example, interfaces for data input and output devices, referred to as I/O devices, storage devices, network devices, and the like. The I/O interface(s) 208 may facilitate communication between the imaging device 102, the user device 204, and various other computing devices connected in a networked environment. The VO interface(s) 208 may also provide a communication pathway for one or more components of the imaging device 102. Examples of such components include, but are not limited to, input device, such as keyboards and a touch enabled graphical user interface.

The memory 210 may store one or more computer-readable instructions, which may be fetched and executed to provide print interfaces to users for providing print instructions. The memory 210 may include any non-transitory computer-readable medium including, for example, volatile memory such as RAM, or non-volatile memory such as EPROM, flash memory, and the like. The imaging device 102 further includes engine(s) 212 and data 214.

The engine(s) 212 may be implemented as a combination of hardware and programming (for example, programmable instructions) to implement one or more functionalities of the engine(s) 212. In examples described herein, such combinations of hardware and programming may be implemented in several different ways. For example, the programming for the engine(s) 212 may be processor executable instructions stored on a non-transitory machine-readable storage medium and the hardware for the engine(s) 212 may include a processing resource (for example, one or more processors), to execute such instructions. In the present examples, the machine-readable storage medium may store instructions that, when executed by the processing resource, implement engine(s) 212. In such examples, the imaging device 102 may include the machine-readable storage medium storing the instructions and the processing resource to execute the instructions, or the machine-readable storage medium may be separate but accessible to the imaging device 102 and the processing resource. In other examples, engine(s) 212 may be implemented by electronic circuitry. The engine(s) 212 may further include circuitry and hardware for performing print and scan operations.

The data 214 includes data that is either stored or generated as a result of functionalities implemented by any of the engine(s) 212. The engine(s) 212 of the imaging device 102 include the print monitoring engine 104, the print capacity estimation engine 108, the ink cartridge controlling engine 110, and other engine(s) 216. The other engine(s) 216 may implement functionalities that supplement applications or functions performed by the engine(s) 212. Further, the data 214 may include ink level and print count data 218, print capacity data 220, and other data 222.

As previously discussed, the imaging device 102 may support various functionalities, such as scanning of a document, printing of a document, photocopying of a document, 3D printing, and other similar functions. The imaging device 102 may include the ink cartridge 106 as a source of ink or other similar fluid to be used for performing the various functionalities. In one example, the imaging device 102 may be located in a secure home or office environment to perform the various functionalities. Further, in one example, the user of the imaging device 102 may subscribe to a periodic print service where the user may be allowed to take a predetermined number of prints within a predetermined time period with a regular supply of ink cartridges during validity of the subscription. In another example, the user of the imaging device 102 may buy ink cartridges whenever ink in the ink cartridges gets utilized.

In operation, the user may install a new ink cartridge, say, the ink cartridge 106 in the imaging device 102 to use the imaging device 102. Once the ink cartridge 106 is installed, the print monitoring engine 104 may start monitoring an ink level of the ink cartridge 106. The ink level, say, 90% ink level of the ink cartridge 106 may indicate a percentage volume of ink in the ink cartridge 106. For example, if the ink cartridge 106 has the ink level as 90%, the current volume of ink in the ink cartridge 106 may then be equal to 90% of total ink capacity of the ink cartridge 106.

The print monitoring engine 104 may further monitor the print count for each one percent drop in the ink level. Each one percent drop in the ink level indicates one percent depletion in the volume of ink, beginning from a hundred percent ink level. Thus, a one percent drop in the ink level from 91% to 90% may indicate that the volume of ink is depleted by 1% of the total ink capacity. In order words, change of ink level from 91% to 90% may indicate that 1% of the total ink capacity of the ink cartridge 106 has been used. The print count for a current ink level may indicate a number of prints obtained while depletion of ink to the current ink level from a consecutive ink level. The current ink level of the ink cartridge 106 indicates a percentage volume of ink currently available in the ink cartridge 106. For example, if 10 prints have been obtained while ink level changed from 91% to 90%, then the print count for 91% ink level would be 10.

In one example, the print count may be determined by the print monitoring engine 104 using one or more sensors connected to a print unit of the imaging device 102. Whenever a print is obtained, for example, a page is printed by the print unit of the imaging device 102, the sensor may update the print monitoring engine 104. Further, to keep a track of the print count for each ink level, the sensor may use a counter or a flag that may be reset to zero each time the ink level is changed.

In one example implementation of the present subject matter, the print monitoring engine 104 may maintain a print counter, for example, nPrints, to keep a track of print counts for each ink level. A value of the print counter may be initially zero, when the ink cartridge 106 is installed and the ink level is 100%. The print counter may be incremented by a value of 1 for each single print being taken. Thus, for "n" prints the value of the print counter may be "n". Once the ink level changes from the current ink level, say, 100% to 99%, the value of print counter, i.e., "n" may be attributed as the print count for the current ink level 99%. Further, the print counter may be reset to zero. In one example, the print monitoring engine 104 may maintain a print count array of 99 elements to record the print count for each ink level. Each array may indicate an ink level, such that the value of each array element may indicate the print count for the ink level being represented by the array element. Further, the value of each array element may be equal to the print counter for the array element.

An example print count array is illustrated below:

Print count array=(Array[99]; Array[98]; Array[97]; . . . Array[m])

where Array[m] represents the $m^{th}$ ink level and the value of Array[m] indicates print count for the current ink level. For example, Array[99] represents 99% ink level and the value of Array[99] indicates print count for 99% ink level. In one example, the $m^{th}$ ink level may be the current ink level of the ink cartridge 106.

As previously described, when a new ink cartridge is installed the ink level will be 100% and the print count will be zero. Thereafter, the print counter may be incremented by a value of 1 for each single print being taken. When the ink level reaches 99%, Array[99] will be filled with the value of the print counter and the print counter will be reset to zero. Similarly, as the ink level reaches 98%, Array[98] will be filled with the value of the print counter and the print counter will be reset to zero. The array may keep on getting updated till the ink cartridge 106 gets deactivated, the last array element may thus be Array[m] corresponding to current ink level of the deactivated ink cartridge.

An example print count array for a deactivated ink cartridge is illustrated below:

Print count array=([10]; [15]; [13];[20]; [5] . . . [8])

where [10] represents print count 10 for the ink level 99%, [15] represents print count 15 for the ink level 98%, [13] represents print count 13 for the ink level 97%, [20] represents print count 20 for the inklevel96%, [5] represents print count 5 for the ink level 95%, and [8] represents print count 8 for the current ink level, say, 45%.

In one example, the print monitoring engine 104 may save the print count array and ink level data in the ink level and print count data 218. Further, in one example, the print count array and the ink level data may be monitored and saved by the user device 204. The user device 204, may obtain the ink level and the print counter value from the print monitoring engine 104 and accordingly update the print count array.

Further, upon occurrence of a predetermined event, the imaging device 102 may deactivate the ink cartridge 106. In one example, the ink cartridge controlling engine 110 may monitor the occurrence of the predetermined event, such as discontinuation of a subscription service or a technical fault in either the imaging device 102 or the ink cartridge 106. In one example, upon discontinuation of the subscription service, the ink cartridge controlling engine 110 may receive a deactivation instruction, for example, from the user device 204 or the service provider remotely connected to the imaging device 102 and the user device 204. In response, the ink cartridge controlling engine 110 may deactivate the ink cartridge 106. Similarly, in case of a technical fault, the ink cartridge controlling engine 110 may receive a deactivation instruction from the print unit or other components of the imaging device 102. The ink cartridge controlling engine 110 may accordingly deactivate the ink cartridge 106. In one example, the ink cartridge controlling engine 110 may deactivate the ink cartridge 106 by setting a flag or a variable or a flip flop in a cartridge acumen or an imaging device NVM.

Once the ink cartridge 106 is deactivated, the user, say, the operator of the imaging device 102 or a service provider may determine if the ink cartridge 106 may be re-activated. In one example, the user may obtain the print capacity estimate of the ink cartridge 106 to determine if the ink cartridge 106 may be activated. The print capacity estimate of the ink cartridge 106 may be determined by the print capacity estimation engine 108 of the imaging device 102, cartridge based at least on the average print rate and the current ink level.

The print capacity estimation engine 108 may initially determine the average print rate for the ink cartridge 106 based on the print count for each one percent drop in ink level beginning from a ninety-nine percent ink level up to a current ink level of the ink cartridge 106. In one example, to obtain the average print rate, the print capacity estimation engine 108 may determine a plurality of ink levels for which individual print counts have been determined and stored in the print count array. For instance, in the above example, the current ink level is 45%, therefore, the print capacity estimation engine 108 may determine that for print counts have been obtained for ink levels upto 45%. In one example, if the current ink level is below a predefined ink level, say, ink level 10, the print capacity estimation engine 108 may determine the print capacity of the of the ink cartridge 106 to be low. The user may decide not to activate the ink cartridge 106.

The print capacity estimation engine 108 may then cluster such a plurality of ink levels into a plurality of ink level subsets beginning from the hundred percent ink level up to the current ink level. In one example, the print capacity estimation engine 108 may use a model of overlapping moving windows to obtain the plurality of ink level subsets. The print capacity estimation engine 108 may use overlapping moving windows of a predetermined width to create the plurality of ink level subsets beginning from the ninety nine percent ink level up to the current ink level such that a first ink level subset is created for a predetermined width with the hundred percent ink level as an initial ink level. Further each subsequent ink level subset is created by shifting forward the initial ink level of a preceding ink level subset by a predetermined value, say, 1, 2, 3 etc.

In one example, the predetermined width of the moving window or the ink level subset may be equal to a predetermined number of ink levels, say, 2, 3, 5, 7, depending upon level of accuracy sought. For example, if the predetermined width is chosen to be 5, each ink level subset may include 5 ink levels. For instance, the first ink level subset may be created for ink levels 99, 98, 97, 96, and 95. A second ink level subset may be created for ink levels 98, 97, 96, 95, and 94, the predetermined value for shifting forward being 1.

The print capacity estimation engine 108 further is to obtain an average print count for each of the plurality of ink level subsets based on a print count for each ink level included in the ink level subset. In one example, the print capacity estimation engine 108 may obtain an average of the print counts for each ink level included in the ink level subset to obtain the average print count for the ink level subset. An example equation for calculating average print count for an ink level subset is illustrated below in equation 1:

$$\text{Average print count}=((\text{Array}[y]+\text{Array}[y-1]+\ldots+\text{Array}[y-x])/x) \quad (1)$$

where y is the initial ink level and the value of Array[y] indicates print count for the initial ink level, y−1 is a subsequent initial ink level and the value of Array[y−1] indicates print count for the ink level, y−x is a last ink level of the ink level subset, placed x ink levels away from the initial ink level.

An example equation for calculating average print count for a subsequent ink level subset is illustrated below in equation 2:

$$\text{Average print count}=\{(\text{Array}[y-1]+\text{Array}[y-2]+\ldots+\text{Array}[y-1-x])/x\} \quad (2)$$

where "y−1" is the initial ink level obtained by shifting forward, by a value of 1, the initial ink level "y" of the previous ink level subset, "y−1−x" is a last ink level of the subsequent ink level subset, placed x ink levels away from the initial ink level.

The print capacity estimation engine 108 may thus obtain the average print count for each of the plurality of ink level subsets till an array having the current ink level as the last ink level reached. In one example, the print capacity estimation engine 108 may store the average print count for each of the plurality of ink level subsets in the print capacity data 220. In one example, the print capacity estimation engine 108 may store the average print counts in a graphical or a tabular form. An example print count table is illustrated below, as Table 1

TABLE 1

| Ink Level Subset | Print Count |
|---|---|
| 99-95% | 13 |
| 98-94% | 12 |
| 97-93% | 5 |
| . | |
| . | |
| . | |
| 49-45% | 11 |

The Table 1 illustrates print counts for the ink level subsets starting from the first ink level subset to a last ink level subset for the deactivated ink cartridge 106.

Further, the print capacity estimation engine 108 may determine a lowest average print count from among average print counts obtained for the plurality of ink level subsets and assign the lowest average print count as the average print rate for the ink cartridge 106. For instance, in the above example, assuming the print count "5" to be the lowest average print count, the print capacity estimation engine 108 may determine the average print rate for the ink cartridge 106 to be equal to 5.

The print capacity estimation engine 108 may further determine the print capacity estimate of the ink cartridge 106 based at least on the average print rate and the current ink level. In one example, the print capacity estimation engine 108 may compute a product of the average print rate and the current ink level to obtain an estimate of number of prints to be printed using the ink cartridge 106. The estimate of number of prints may then be assigned as the print capacity estimate. For instance, in the current example described above, the print capacity estimation engine 108 may multiply the average print rate "5" with the current ink level "45%" to obtain the print capacity estimate as 225 prints.

The ink cartridge controlling engine 110 may subsequently render the print capacity estimate to the user of the imaging device 102. The user, on receiving the print capacity estimate, may make a decision regarding re-activation of the ink cartridge 106. For instance, on determining the print capacity estimate to be useful for meeting print job requirement of the user, the user may decide to get the ink cartridge activated. In one example, the user may get the ink cartridge activated by reactivating the subscription service. In another example, the user may get the ink cartridge activated by getting technical fault diagnosed and corrected. The user may then send an activation input to the ink cartridge controlling engine 110 for activating the deactivated ink cartridge 106. The activation input may indicate completion of an activation event by the user, such as payment of subscription service fee or repair of the ink cartridge 106 or the imaging device 102. In one example, the subscription service fee may be computed based on the print capacity estimate and an average print fee. For example, if the average print fee, i.e., average cost of a single print is $1, the subscription service fee in the previous example, for 225 prints may be $ 225.

On receiving the activation input from the user, the ink cartridge controlling engine 110 may activate the ink cartridge 106. In one example, the ink cartridge controlling engine 110 may activate the ink cartridge 106 by resetting a flag or a variable or a flip flop in a cartridge acumen or an imaging device NVM.

Figure 3:
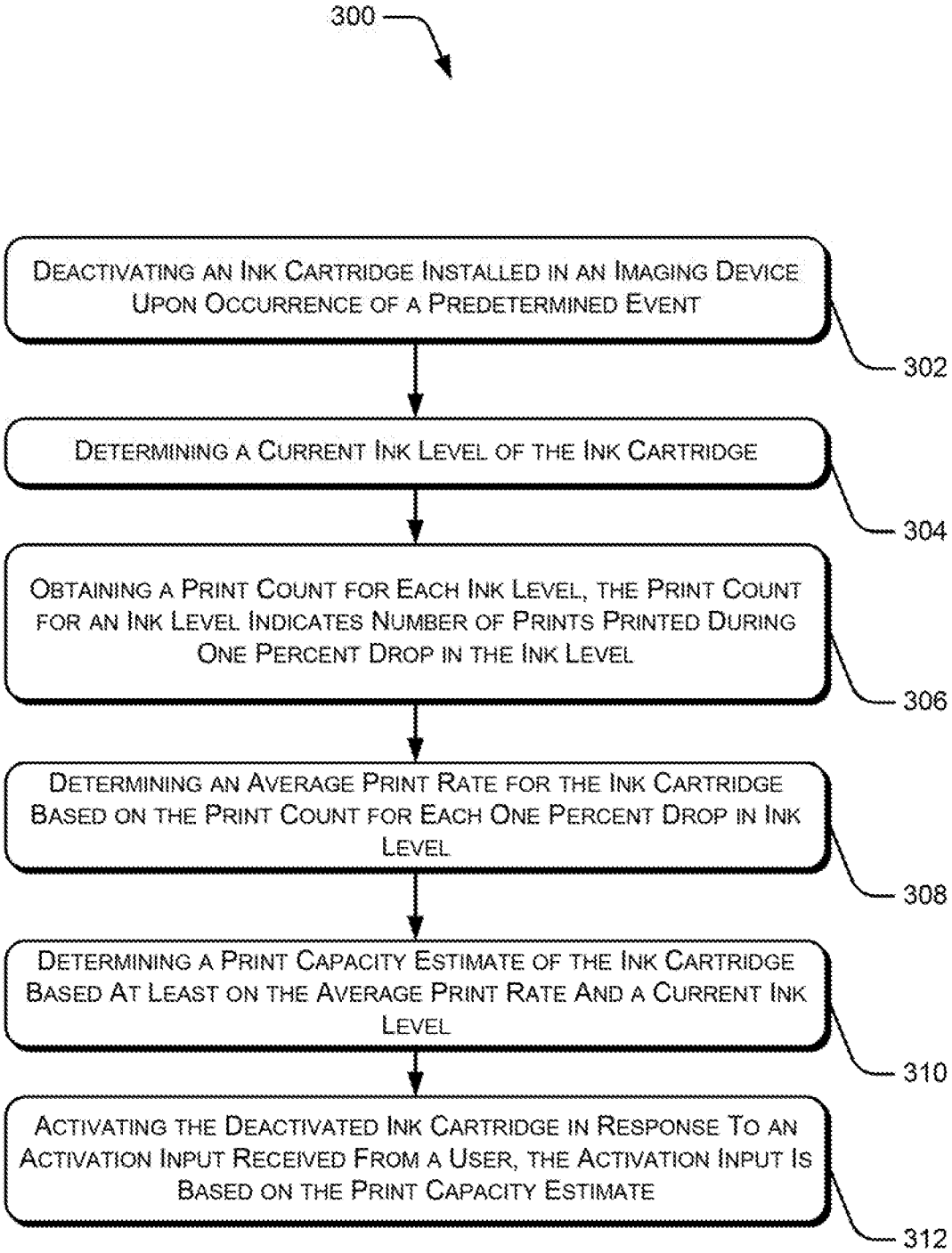
FIG. 3 illustrates a method for activating an ink cartridge, according to an example implementation of the present subject matter.
Figure 4:
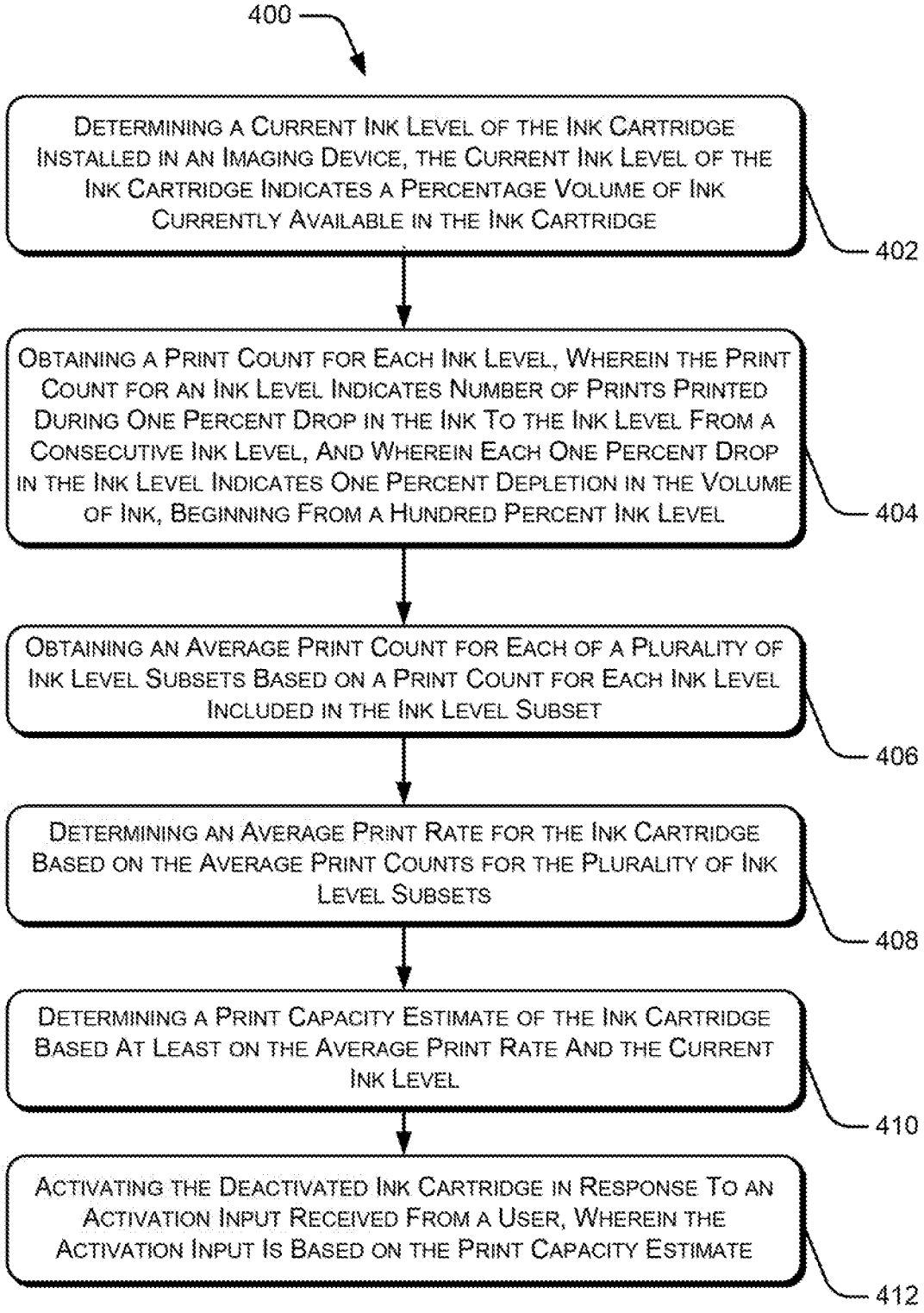
FIG. 4 illustrates a method for activating an ink cartridge, according to another example implementation of the present subject matter.

FIGS. 3 and 4 illustrate example methods 300 and 400, respectively, for activating an ink cartridge. The order in which the methods are described is not intended to be construed as a limitation, and any number of the described method blocks may be combined in any order to implement the methods, or an alternative method. Furthermore, methods 300 and 400 may be implemented by processing resource or computing device(s) through any suitable hardware, non-transitory machine readable instructions, or combination thereof.

It may also be understood that methods 300 and 400 may be performed by programmed computing devices, such as the user device 204 and the imaging device 102, as depicted in FIGS. 1-2. Furthermore, the methods 300 and 400 may be executed based on instructions stored in a non-transitory computer readable medium, as will be readily understood. The non-transitory computer readable medium may include, for example, digital memories, magnetic storage media, such as one or more magnetic disks and magnetic tapes, hard drives, or optically readable digital data storage media. The methods 300 and 400 are described below with reference to the user device 204 and the imaging device 102 as described above; other suitable systems for the execution of these methods may also be utilized. Additionally, implementation of these methods is not limited to such examples.

FIG. 3 illustrates the method 300 for activating an ink cartridge, according to an example implementation of the present subject matter. At block 302, an ink cartridge installed in an imaging device is deactivated. In one example, the ink cartridge is deactivated by the imaging device upon occurrence of a predetermined event, such as discontinuation of a subscription service or occurrence of a technical fault.

At block 304, a current ink level of the ink cartridge is determined. In one example, the current ink level of the ink cartridge indicates a percentage volume of ink currently available in the ink cartridge.

At block 306, a print count is obtained for each ink level of the ink cartridge. In one example, the print count for an ink level indicates number of prints printed during one percent drop in the ink to the ink level from a consecutive ink level. Each one percent drop in the ink level indicating one percent depletion in the volume of ink, beginning from a hundred percent ink level.

At block 308, an average print rate for the ink cartridge is determined. In one example, the average print rate is determined based on the print count for each one percent drop in ink level beginning from the hundred percent ink level up to a current ink level of the ink cartridge. The average print rate indicating an average minimum number of prints obtained using one percent volume of ink.

At block 310, a print capacity estimate of the ink cartridge is determined. In one example, the print capacity estimate is determined based at least on the average print rate and the current ink level.

At block 312, the deactivated ink cartridge is activated. In one example, the ink cartridge is activated in response to an activation input received from a user. In one example, the activation input is based on the print capacity estimate.

FIG. 4 illustrates a method for activating an ink cartridge, according to an example implementation of the present subject matter. At block 402, a current ink level is determined for an ink cartridge installed in an imaging device, such as the imaging device 102. In one example, the current ink level is determined after ink cartridge has been deactivated upon occurrence of a predetermined event, such as discontinuation of a subscription service or occurrence of a technical fault. Further, the current ink level of the ink cartridge indicates a percentage volume of ink currently available in the ink cartridge.

At block 404, a print count for each ink level is obtained. In one example, the print count for an ink level indicates number of prints printed during one percent drop in the ink to the ink level from a consecutive ink level. Further, each one percent drop in the ink level indicates one percent depletion in the volume of ink, beginning from a hundred percent ink level.

At block 406, an average print count is obtained for each of a plurality of ink level subsets. In one example, average print count is obtained based on a print count for each ink level included in the ink level subset. In one example, the plurality of ink level subsets is obtained from a plurality of ink levels, beginning from a ninety-nine percent ink level up to the current ink level, using overlapping moving windows of a predetermined width equal to a predetermined number of ink levels. For instance, a first ink level subset is created with the ninety-nine percent ink level as an initial ink level and each subsequent ink level subset is created by shifting forward the initial ink level of a preceding ink level subset by a predetermined value.

At block 408, an average print rate is determined for the ink cartridge. The average print rate is determined based on the average print counts for the plurality of ink level subsets. In one example, a lowest average print count is determined from among average print counts obtained for the plurality of ink level subsets. Further, the lowest average print count is assigned as the average print rate for the ink cartridge.

At block 410, a print capacity estimate of the ink cartridge is determined based at least on the average print rate and the current ink level. In one example, a product of the average print rate and the current ink level is computed to obtain an estimate of number of prints to be printed using the ink cartridge. The estimate of number of prints is used as the print capacity estimate of the ink cartridge.

At block 412, the deactivated ink cartridge is then activated in response to an activation input received from a user. In one example, the user may decide to provide the activation input based on the print capacity estimate.

Figure 5:
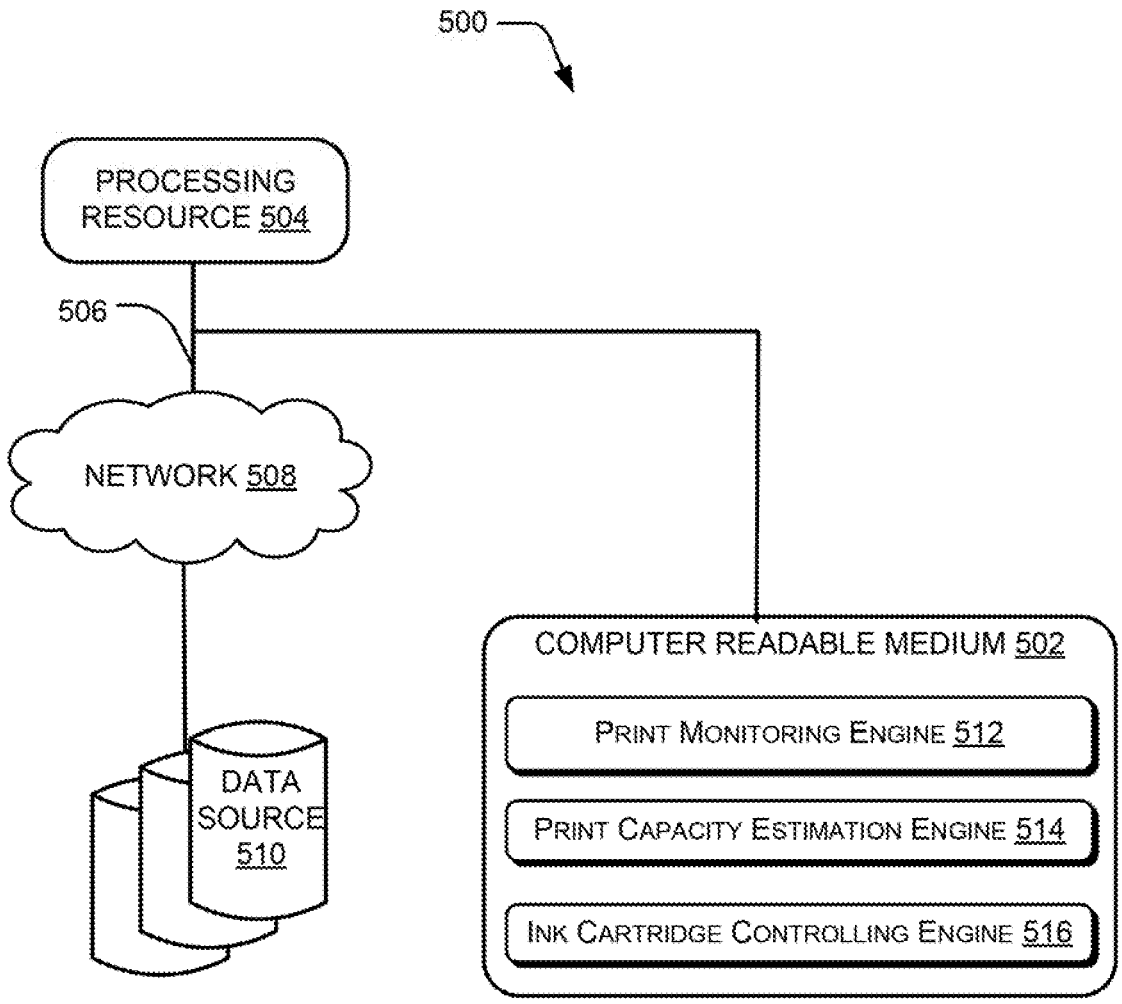
FIG. 5 illustrates a network environment having a non-transitory computer readable medium for activating an ink cartridge, according to an example implementation of the present subject matter.

FIG. 5 illustrates an example network environment 500 using a non-transitory computer readable medium 502 for activating an ink cartridge, according to an example implementation of the present subject matter. The network environment 500 may be a public networking environment or a private networking environment. In one example, the network environment 500 includes a processing resource 504 communicatively coupled to the non-transitory computer readable medium 502 through a communication link 506.

For example, the processing resource 504 can be a processor of an electronic device, such as the imaging device 102 or the user device 204. The non-transitory computer readable medium 502 can be, for example, an internal memory device or an external memory device. In one example, the communication link 506 may be a direct communication link, such as one formed through a memory read/write interface. In another example, the communication link 506 may be an indirect communication link, such as one formed through a network interface. In such a case, the processing resource 504 can access the non-transitory computer readable medium 502 through a network 508. The network 508 may be a single network or a combination of multiple networks and may use a variety of communication protocols.

The processing resource 504 and the non-transitory computer readable medium 502 may also be communicatively coupled to data sources 510 over the network 508. The data sources 510 can include, for example, databases and computing devices. The data sources 510 may be used by the database administrators and other users to communicate with the processing resource 504.

In one example, the non-transitory computer readable medium 502 includes a set of computer readable instructions, such as an print monitoring engine 512, a print capacity estimation engine 514, an ink cartridge controlling engine 516. As would be understood, the print monitoring engine 512 implements the functionality of the print monitoring engine 104, the print capacity estimation engine 514 implements the functionality of the print capacity estimation engine 108, and the ink cartridge controlling engine 516 implements the functionality of the ink cartridge controlling engine 110. The set of computer readable instructions, referred to as instructions hereinafter, can be accessed by the processing resource 504 through the communication link 506 and subsequently executed to perform acts for facilitating facsimile communication.

For discussion purposes, the execution of the instructions by the processing resource 504 has been described with reference to various components introduced earlier with reference to the description of FIGS. 1-2.

On execution by the processing resource 504, the print monitoring engine 512, may monitor an ink level of an ink cartridge installed in an imaging device, such as the imaging device 102. The ink level of the ink cartridge indicates a percentage volume of ink in the ink cartridge, such that each one percent drop in the ink level indicates one percent depletion in the volume of ink, beginning from a hundred percent ink level.

The print monitoring engine 512 may further track a print count for each ink level. In one example, the print count for a current ink level indicates number of prints printed during one percent drop in the ink to the current ink level from a consecutive ink level. The current ink level of the ink cartridge indicates a percentage volume of ink currently available in the ink cartridge.

Further, upon occurrence of a predetermined event, the ink cartridge controlling engine 516 may deactivate the ink cartridge. In one example, the predetermined event may include discontinuation of a subscription service or occurrence of a technical fault. Subsequently, the print capacity estimation engine 514 may determine an average print rate for the ink cartridge based on the print count for each one percent drop in ink level beginning from the hundred percent ink level up to a current ink level of the ink cartridge. The average print rate indicating an average minimum number of prints obtained using one percent volume of ink.

The print capacity estimation engine 514 may further determine a print capacity estimate of the ink cartridge based at least on the average print rate and the current ink level. The print capacity estimation engine 514 may further render the print capacity estimate to a user of the imaging device. The user may accordingly use the print capacity estimate to ascertain whether or not to activate the deactivated ink cartridge in response. To activate the deactivated ink cartridge, the user may share an activation input with the ink cartridge controlling engine 516. The ink cartridge controlling engine 516 may accordingly activate the deactivated ink cartridge in response to the activation input from the user.

Although examples for the present subject matter have been described in language specific to structural features and/or methods, it should be understood that the appended claims are not limited to the specific features or methods described. Rather, the specific features and methods are disclosed and explained as examples of the present subject matter.

What is claimed is:

1. An imaging device comprising:

a print monitoring engine to:

monitor an ink level of an ink cartridge installed in the imaging device; and track a print count for each ink level, wherein the print count for each ink level indicates a number of prints printed during one percent drop in the ink level;

a print capacity estimation engine to:

determine an average print rate for the ink cartridge based on the print count for each one percent drop in ink level; and determine a print capacity estimate of the ink cartridge based at least on the average print rate and a current ink level; and an ink cartridge controlling engine to:

deactivate the ink cartridge upon occurrence of a predetermined event; and activate the deactivated ink cartridge in response to an activation input from a user, wherein the activation input is based on the print capacity estimate.

2. The imaging device as claimed in claim 1, wherein the print capacity estimation engine further is to obtain an average print count for each of a plurality of ink level subsets based on the print count for each ink level included in the ink level subset, wherein the plurality of ink level subsets is obtained from a plurality of ink levels, beginning from a hundred percent ink level up to the current ink level, using overlapping moving windows of a predetermined width equal to a predetermined number of ink levels, and wherein a first ink level subset is created with the hundred percent ink level as an initial ink level, and wherein each subsequent ink level subset is created by shifting forward the initial ink level of a preceding ink level subset by a predetermined value.

3. The imaging device as claimed in claim 2, wherein the print capacity estimation engine further is to:

determine a lowest average print count from among average print counts obtained for the plurality of ink level subsets; and assign the lowest average print count as the average print rate for the ink cartridge.

4. The imaging device as claimed in claim 1, wherein the print capacity estimation engine further is to compute a product of the average print rate and the current ink level to obtain an estimate of number of prints to be printed using the ink cartridge.

5. The imaging device as claimed in claim 1, wherein the ink cartridge controlling engine further is to:

render the print capacity estimate to the user of the imaging device; and receive the activation input from the user, indicating completion of an activation event by the user.

6. A method for activating an ink cartridge, the method comprising:

deactivating an ink cartridge installed in an imaging device upon occurrence of a predetermined event;

determining a current ink level of the ink cartridge;

obtaining a print count for each ink level, wherein the print count for an ink level indicates number of prints printed during one percent drop in the ink level;

determining an average print rate for the ink cartridge based on the print count for each one percent drop in ink level;

determining a print capacity estimate of the ink cartridge based at least on the average print rate and the current ink level; and activating the deactivated ink cartridge in response to an activation input received from a user, wherein the activation input is based on the print capacity estimate.

7. The method as claimed in claim 6, wherein the determining the average print rate for the ink cartridge comprises:

obtaining an average print count for each of a plurality of ink level subsets based on the print count for each ink level included in the ink level subset, wherein the plurality of ink level subsets is obtained from a plurality of ink levels, beginning from a hundred percent ink level up to the current ink level, using overlapping moving windows of a predetermined width equal to a predetermined number of ink levels, and wherein a first ink level subset is created with the hundred percent ink level as an initial ink level, and wherein each subsequent ink level subset is created by shifting forward the initial ink level of a preceding ink level subset by a predetermined value.

8. The method as claimed in claim 7, wherein the determining the average print rate for the ink cartridge comprises:

determining a lowest average print count from among average print counts obtained for the plurality of ink level subsets; and assigning the lowest average print count as the average print rate for the ink cartridge.

9. The method as claimed in claim 6, wherein determining the print capacity estimate comprises computing a product of the average print rate and the current ink level to obtain an estimate of number of prints to be printed using the ink cartridge.

10. The method as claimed in claim 6, further comprising:

rendering the print capacity estimate to the user of the imaging device; and receiving the activation input from the user, indicating completion of an activation event by the user.

11. A non-transitory computer readable medium having a set of computer readable instructions that, when executed, cause a processor to:

monitor an ink level of an ink cartridge installed in an imaging device;

track a print count for each ink level, wherein the print count for each ink level indicates number of prints printed during one percent drop in the ink level;

determine an average print rate for the ink cartridge based on the print count for each one percent drop in ink level;

deactivate the ink cartridge upon occurrence of a predetermined event;

determine a print capacity estimate of the ink cartridge based at least on the average print rate and a current ink level; and activate the deactivated ink cartridge in response to an activation input from a user, wherein the activation input is based on the print capacity estimate.

12. The computer readable medium as claimed in claim 11, wherein the computer readable instructions, when executed, further cause the processor to obtain an average print count for each of a plurality of ink level subsets based on the print count for each ink level included in the ink level subset, wherein the plurality of ink level subsets is obtained from a plurality of ink levels, beginning from a hundred percent ink level up to the current ink level, using overlapping moving windows of a predetermined width equal to a predetermined number of ink levels, and wherein a first ink level subset is created with the hundred percent ink level as an initial ink level, and wherein each subsequent ink level subset is created by shifting forward the initial ink level of a preceding ink level subset by a value of one, such that the initial ink levels of the ink level subsets are in a numerically depreciating order.

13. The computer readable medium as claimed in claim 12, wherein the computer readable instructions, when executed, further cause the processor to:

determine a lowest average print count from among average print counts obtained for the plurality of ink level subsets; and assign the lowest average print count as the average print rate for the ink cartridge.

14. The computer readable medium as claimed in claim 12, wherein the computer readable instructions, when executed, further cause the processor to compute a product of the average print rate and the current ink level to obtain an estimate of number of prints to be printed using the ink cartridge.

15. The computer readable medium as claimed in claim 12, wherein the computer readable instructions, when executed, further cause the processor to:

render the print capacity estimate to the user of the imaging device; and receive the activation input from the user, indicating completion of an activation event by the user.

* * * * *